US007954281B2

(12) United States Patent
Jaster

(10) Patent No.: US 7,954,281 B2
(45) Date of Patent: Jun. 7, 2011

(54) SKYLIGHT TUBE WITH INFRARED HEAT TRANSFER

(75) Inventor: Paul Jaster, Carlsbad, CA (US)

(73) Assignee: Solatube International, Inc., Vista, CA (US)

( * ) Notice: Subject to any disclaimer, the term of this patent is extended or adjusted under 35 U.S.C. 154(b) by 856 days.

(21) Appl. No.: 11/595,381

(22) Filed: Nov. 8, 2006

(65) Prior Publication Data

US 2008/0104903 A1 May 8, 2008

(51) Int. Cl.
*E04B 7/18* (2006.01)

(52) U.S. Cl. ..... 52/200; 428/34

(58) Field of Classification Search ..... 52/200; 428/457; 359/359, 577
See application file for complete search history.

(56) References Cited

U.S. PATENT DOCUMENTS

| | | | | | |
|---|---|---|---|---|---|
| 4,372,292 | A | * | 2/1983 | Ort | 126/622 |
| 5,099,622 | A | | 3/1992 | Sutton | |
| 5,239,406 | A | * | 8/1993 | Lynam | 359/275 |
| 5,360,659 | A | * | 11/1994 | Arends et al. | 428/216 |
| 5,896,712 | A | * | 4/1999 | Chao | 52/200 |
| 5,896,713 | A | * | 4/1999 | Chao et al. | 52/200 |
| RE36,496 | E | * | 1/2000 | Sutton | 52/200 |
| 6,014,845 | A | * | 1/2000 | Jain et al. | 52/200 |
| 6,035,593 | A | * | 3/2000 | Chao et al. | 52/200 |
| 6,113,255 | A | | 9/2000 | Shalit | |
| 6,256,135 | B1 | * | 7/2001 | Tench et al. | 359/271 |
| 6,297,907 | B1 | * | 10/2001 | Wang | 359/585 |
| 6,391,400 | B1 | * | 5/2002 | Russell et al. | 428/34 |
| 6,528,782 | B1 | * | 3/2003 | Zhang et al. | 250/226 |
| 6,691,701 | B1 | | 2/2004 | Roth | |
| 2003/0026988 | A1 | | 2/2003 | Lynch et al. | |
| 2004/0191540 | A1 | * | 9/2004 | Jakobi et al. | 428/457 |
| 2005/0099678 | A1 | * | 5/2005 | Wang | 359/359 |
| 2006/0191214 | A1 | | 8/2006 | Rillie | |
| 2007/0163732 | A1 | * | 7/2007 | Konstantin et al. | 160/237 |
| 2009/0167971 | A1 | * | 7/2009 | Powers et al. | 349/18 |

FOREIGN PATENT DOCUMENTS

| | | |
|---|---|---|
| EP | 572411 | 8/2003 |

* cited by examiner

*Primary Examiner* — Eileen Lillis
*Assistant Examiner* — Alp Akbasli
(74) *Attorney, Agent, or Firm* — John L. Rogitz

(57) ABSTRACT

A skylight shaft substrate has a film or coating on its inside surface that reflects visible light while transmitting IR to the tube substrate, which can have a satin black and/or other IR absorbing interior and anodized or other high emissivity exterior to convey heat across the tube so that light is transmitted down the tube but heat transmission is directed through the tube to minimize heating the illuminated space. Or, heat may propagate up through the tube and exit through a clear plastic dome covering the tube.

10 Claims, 4 Drawing Sheets

SKYLIGHT TUBE WITH INFRARED HEAT TRANSFER

FIELD OF THE INVENTION

The present invention relates generally to skylights.

BACKGROUND OF THE INVENTION

In U.S. Pat. Nos. 5,896,713 and 6,035,593, both of which are owned by the same assignee as is the present invention and both of which are incorporated herein by reference, tubular skylights are disclosed. Both of the skylights can use the skylight dome disclosed in U.S. Pat. No. 5,896,712 also owned by the same assignee as is the present invention and also incorporated herein by reference. These inventions represent advances over the prior art and one or more of them has found commercial success.

Briefly, a tubular skylight such as those mentioned above includes a tube assembly mounted between the roof and ceiling of a building. The top end of the tube assembly is covered by a roof-mounted dome or cover, such as the one disclosed in the above-mentioned '712 patent, while the bottom end of the tube assembly is covered by a ceiling-mounted diffuser plate. With this combination, natural light external to the building is directed through the tube assembly into the interior of the building to illuminate the interior.

Tubular skylights use a reflective surface to transport sunlight down a tube from the roof to the interior ceiling. The optical spectral response of the dome, tube, and diffuser and the number of light reflections as light travels down the tube determines how much sunlight will reach the interior of the building. These properties will also determine how much heat, in addition to visible light, will be transported to the interior.

As recognized herein, it is desirable to maximize the amount of visible light (light having wavelengths of between around four hundred nanometers and seven sixty nanometers) that is transmitted down the tube while minimizing the amount of heat (in the form of infrared light of greater than around seven hundred sixty nanometers) that is transmitted into the room. As further recognized herein, most fenestration products designed to minimize solar heat gain unfortunately have drawbacks. For example, tinting the surface of a window with a coating or film typically is not selective, i.e., tinting reduces heat transmission but also reduces visible light transmission. The same is true to a somewhat lesser degree with respect to low-e coatings and/or films that are deposited on windows as well as with respect to multiple glazing layers. Furthermore, the same observations apply to skylights, in which films or coatings that are used to maximize visible light transmission down the tube also maximize heat input into the room and in which optical blocking devices in the dome or diffuser, while blocking IR, also block visible light. Accordingly, the present solutions are provided.

SUMMARY OF THE INVENTION

A skylight assembly includes a transparent dome and a skylight shaft substrate extending away from the dome to convey light entering the dome through the shaft substrate. A spectrally selective film or coating is juxtaposed with an inside surface of the shaft substrate to substantially reflect visible light and to substantially transmit IR light.

If desired, means can be associated with the substrate for conveying heat from an inside surface to an outer surface of the substrate. The means for conveying heat may include an adhesive disposed between a spectrally selective film and the substrate and bearing Carbon black or other IR-absorbing substance particles, and/or it may include a satin black inside surface of the substrate with the outer surface of the substrate being anodized. Or, the substrate can have an outer surface of relatively low IR emissivity, and the inner surface or film has a high emissivity and heat is radiated in the tube and rises up and exits through the dome. Yet again, the substrate can be transparent so that IR is transmitted through it while visible light remains within the tube due to the film or coating.

In another aspect, a skylight shaft assembly includes a hollow shaft substrate defining an inside surface and an outer surface. A substance is associated with the inside surface. The substance substantially reflects visible light impinging on the substance and substantially does not reflect IR light impinging on the substance.

In yet another aspect, a skylight shaft assembly has a hollow shaft substrate defining an inside surface and an outer surface, and means associated with the inside surface for substantially reflecting visible light but not IR light.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
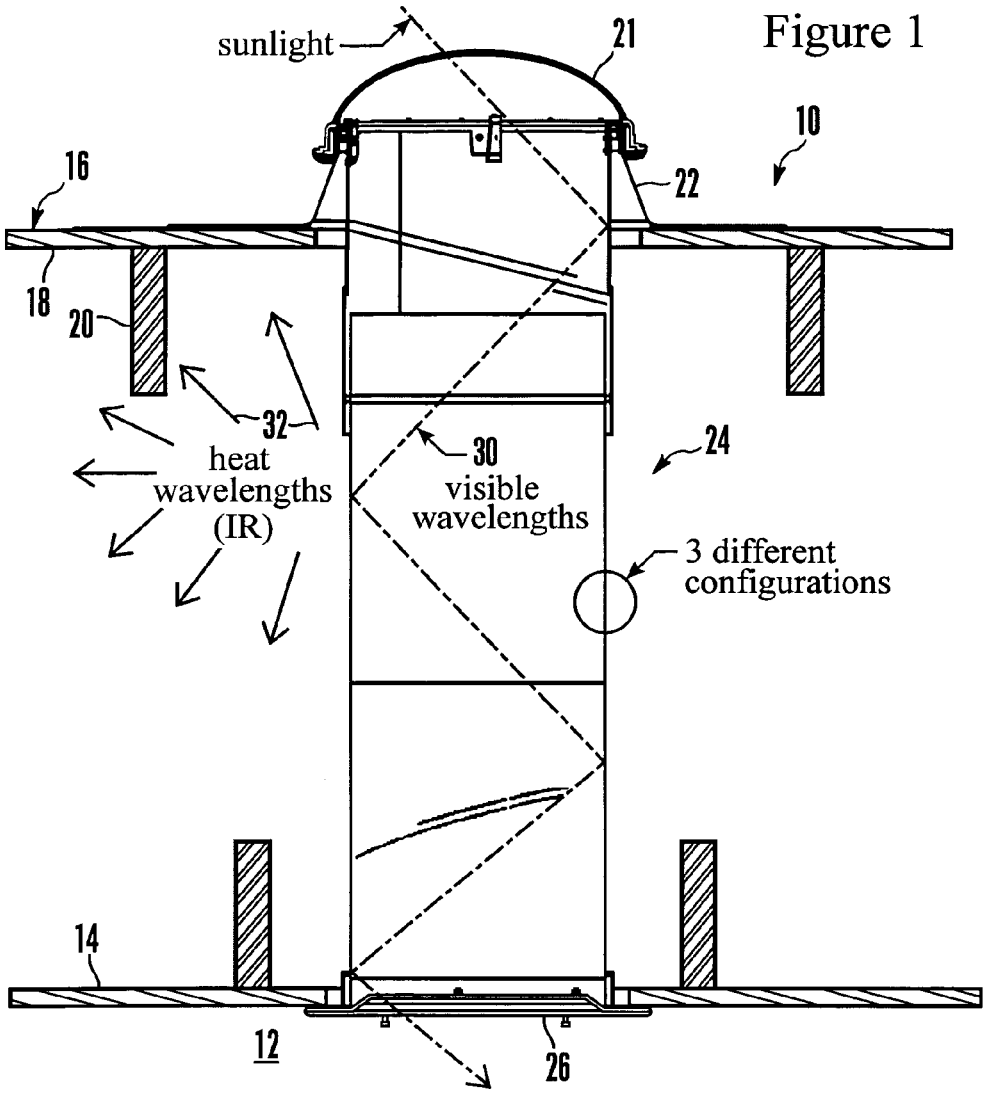
FIG. 1 is a side view in partial cross-section of the tubular skylight of the present invention.

Referring initially to FIG. 1, a tubular skylight made in accordance with the present invention is shown, generally designated 10, for lighting, with natural sunlight, an interior room 12 having a ceiling dry wall 14 in a building, generally designated 16. FIG. 1 shows that the building 16 has a roof 18 and one or more joists 20 that support the roof 18 and ceiling dry wall 14.

As shown in FIG. 1, the skylight 10 includes a rigid hard plastic or glass roof-mounted cover 21. The cover 21 is optically transmissive and preferably is transparent. In one embodiment, the cover 21 can be the cover disclosed in the above-mentioned '712 patent. Or, the cover 21 can be other suitable covers, such as the covers marketed under the trade name "Solatube" by the present assignee.

The cover 21 can be mounted to the roof 18 by means of a ring-like metal flashing 22 that is attached to the roof 18 by means well-known in the art. The metal flashing 22 can be angled as appropriate for the cant of the roof 18 to engage and hold the cover 21 in the generally vertically upright orientation shown.

As further shown in FIG. 1, an internally reflective hollow shaft assembly, generally designated 24, is connected to the flashing 22. The cross-section of the assembly 24 can be cylindrical, rectangular, triangular, etc. Accordingly, while the word "tube" may be used from time to time herein, it is to be understood that the principles of the present invention are not to be limited to a cylinder per se unless otherwise specified.

The shaft assembly 24 extends to the ceiling 14 of the interior room 12. Per the present invention, the shaft assembly 24 directs light that enters the shaft assembly 24 downwardly to a light diffuser assembly, generally designated 26, that is disposed in the room 12 and that is mounted to the ceiling 14 or to a joist 20 as described in the above-mentioned '593 patent. In some implementations for "light wells" the diffuser 26 ordinarily is omitted.

The shaft assembly 24 can be made of a metal such as an alloy of aluminum or steel, or the shaft assembly 24 can be made of plastic or other appropriate material within the disclosure below. The interior of the shaft assembly 24 is rendered in accordance with disclosure below.

As recognized herein, multi-layer polymeric reflective films have been provided that can be configured to reflect or transmit light depending on its wavelength. Such films may be thought of as being spectrally selective. Specifically, the present invention recognizes that multi-layer polymeric reflective films can be configured to reflect visible light as shown by the lines 30 while transmitting IR into the tube substrate (in the embodiment shown in FIG. 1, the heat is transmitted across the tube substrate to the exterior of the skylight as shown by the lines 32, while in other embodiments described below the heat may propagate up the tube substrate). One non-limiting example of such a film is the "Daylighting Film—DF2000MA" made by Minnesota Mining and Manufacturing.

Figure 2:
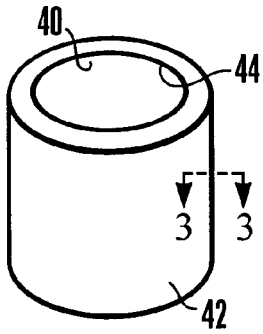
FIG. 2 is a perspective view of the present tube with spectrally selective film or coating.

Accordingly, as shown in FIG. 2 a multilayer selective transmission film or coating 40 which reflects the visible wavelengths and transmits the IR wavelengths can be bonded to a tube substrate 42, it being understood that the tube substrate 42 may be used for any one of the above-described tubes and/or tube segments. Light in the visible wavelengths reflects off the film 40 whereas light in the IR spectrum is transmitted through the film to the tube 42.

Figure 3:
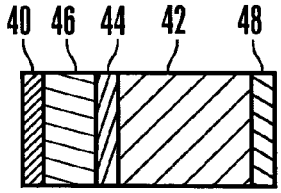
FIG. 3 is a cross-sectional view as seen along the line 3-3 in FIG. 2.

As shown in FIG. 2, the multi-layer film 40 is adhered to the inside surface 44 of the tube 42. FIG. 3 best shows that the film 40 (which could be a coating as indicated in the figure) is bonded to the tube 42 using a clear adhesive 46. The tube 42 may be made of Aluminum, and particularly when a clear adhesive is used, the inside surface 44 may be painted satin black or otherwise treated for high heat absorption. In contrast, the outer surface 48 of the substrate 42 preferably is anodized or painted or otherwise treated so as to have a high conductivity to transfer heat from the inside surface 44 to the outer surface 48. Thus, the outer surface 48 has a high emittance to radiate heat from the tube, whereas the inside surface 44 may have high IR absorption and low IR reflectance characteristics.

Figure 4:
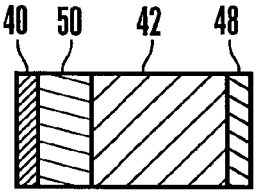
FIG. 4 is a cross-sectional view of an alternate embodiment as would be seen along the line 3-3 in FIG. 2.

Alternatively, instead of rendering the inner surface 44 absorptive, an opaque (IR-absorbing) adhesive 50 may be interposed between the multilayer film or coating 40 and tube substrate 42 as shown in FIG. 4. The adhesive 50 may be a mixture of a clear adhesive and Carbon black or other IR-absorbing substance particles, so that the opaque adhesive has high IR absorption and low IR reflectance characteristics.

Figure 5:
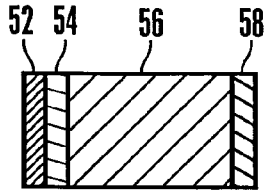
FIG. 5 is a cross-sectional view of another alternate embodiment as would be seen along the line 3-3 in FIG. 2.

As yet another alternative, FIG. 5 shows that a multi-layer coating 52 that is spectrally selective in that is reflects visible light while transmitting IR can be deposited directly onto the an IR-absorptive inner surface 54 of a substrate 56 with high emittance outside surface 58 without requiring an adhesive. The substrate 56 shown in FIG. 5 is in all other essential respects identical to those shown in FIGS. 3 and 4.

Figure 6:
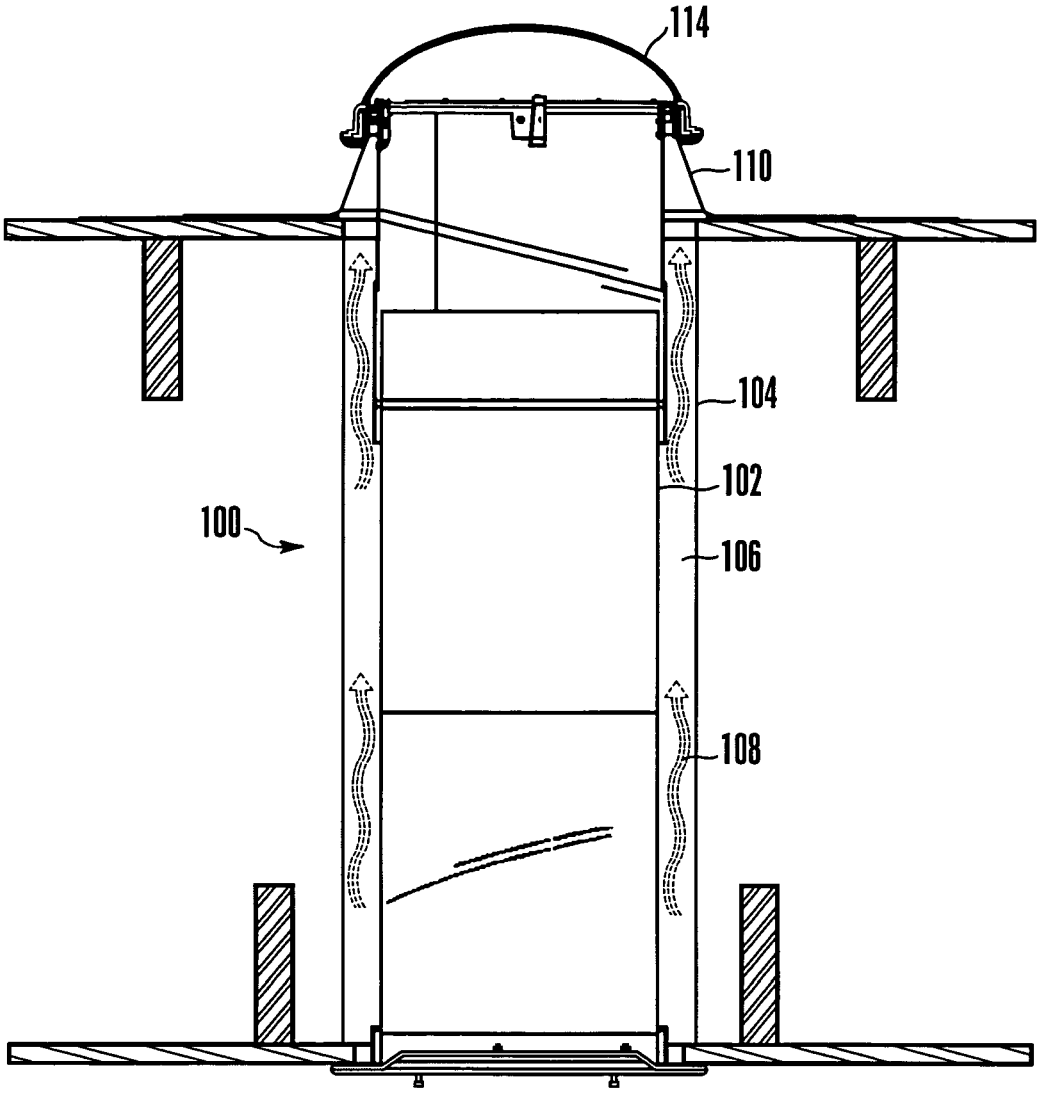
FIG. 6 is a side view in partial cross-section of an alternate tubular skylight of the present invention.

FIG. 6 shows an alternate skylight assembly 100 with tube substrate 102 that in all material respects is identical to the assembly 10 shown in FIG. 1 with the following exceptions. To transmit IR away from the tube, an outer hollow shell 104 can be disposed substantially completely around the tube substrate 102 with a space 106 therebetween up which IR radiation can propagate, as shown by heat lines 108. The heat can propagate out the open top of the shell 104 and, if the top is closed, out of holes 110 formed in a flashing or other structure of the skylight assembly 100. Or, a highly emissive (to IR) clear plastic dome 114 can be provided so that heat rises through the dome and out of the assembly 100.

Figure 7:
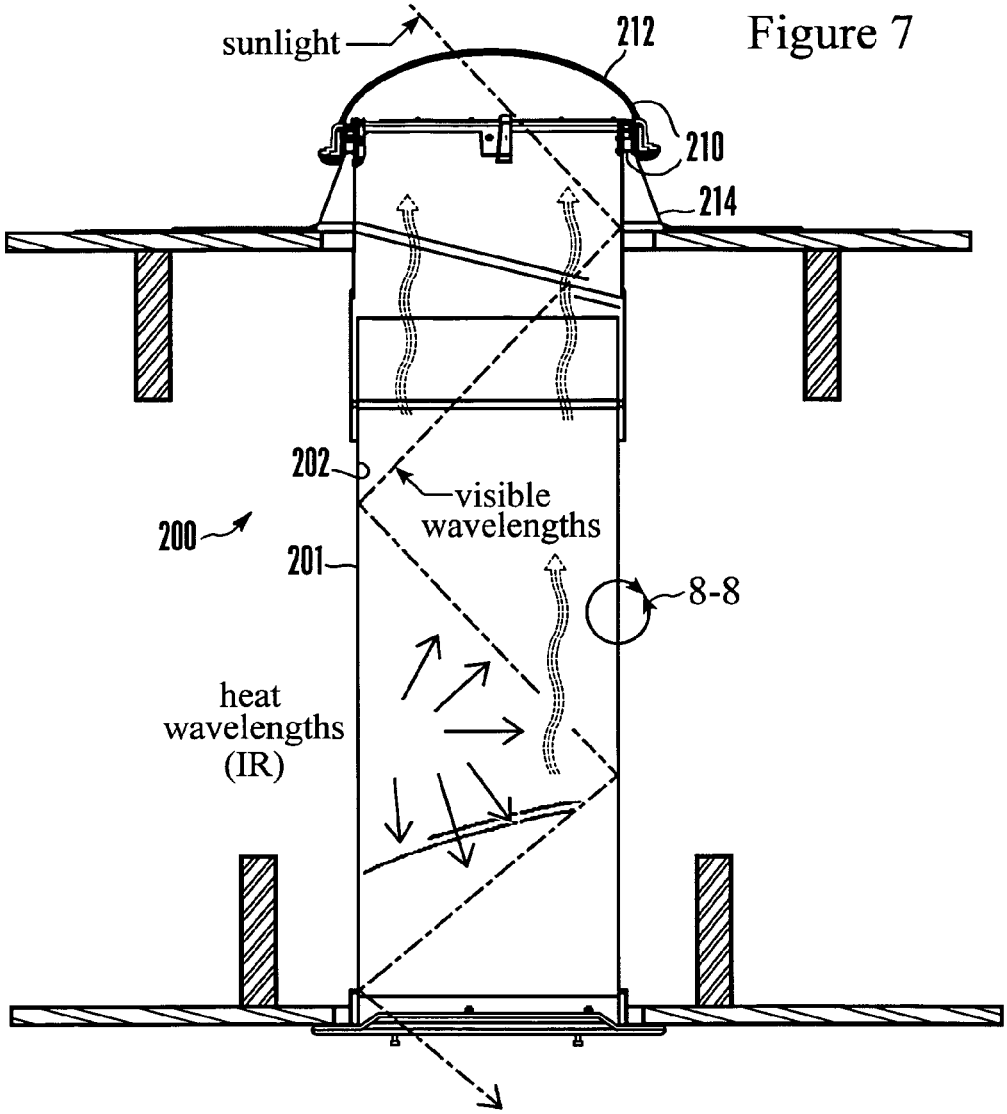
FIG. 7 is a side view in partial cross-section of yet another alternate tubular skylight of the present invention.
Figure 8:
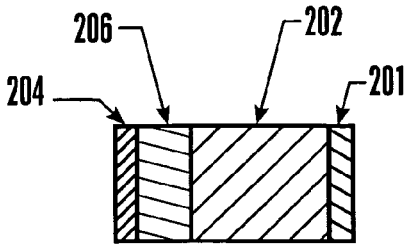
FIGS. 8 and 9 are cross-sections of respective embodiments as seen along the circle 8-8 in FIG. 7.
Figure 9:
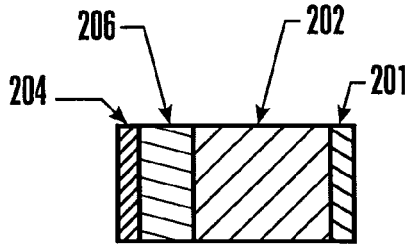

FIGS. 7-9 show an additional alternate skylight assembly 200 that in all material respects is identical to the assembly 10 shown in FIG. 1 with the following exceptions. In both implementations shown in FIGS. 8 and 9, the outer surface 201 of the tube substrate 202 need not be highly emissive to IR. The inner surface area, as was the case with the prior embodiments, preferably is absorbent to IR and reflective to visible light, and so as shown in FIG. 8 a multi-layer film 204 may be applied to the inner surface of the substrate 202 using an IR-absorbing adhesive 206, or the element 204 may be a multi-layer coating that is deposited onto the substrate 202, in which case the element 206 could be the inner surface itself, rendered even more absorptive by, e.g., being painted Carbon black or other IR-absorbing substance. This latter implementation is shown in greater detail in FIG. 9.

In any case, referring back to FIG. 7, heat absorbed by the substrate 202, owing to the low emissivity outer surface 201, mostly propagates up the assembly 200 through openings or holes 210 that may be formed in a skylight dome 212 or between the dome 212 and a flashing 214 to which the dome 212 is mounted. Or, no holes need be provided, in which case the dome 212 preferably is highly emissive to IR so that heat can propagate upwardly through the dome and out of the skylight assembly 200.

Figure 10:
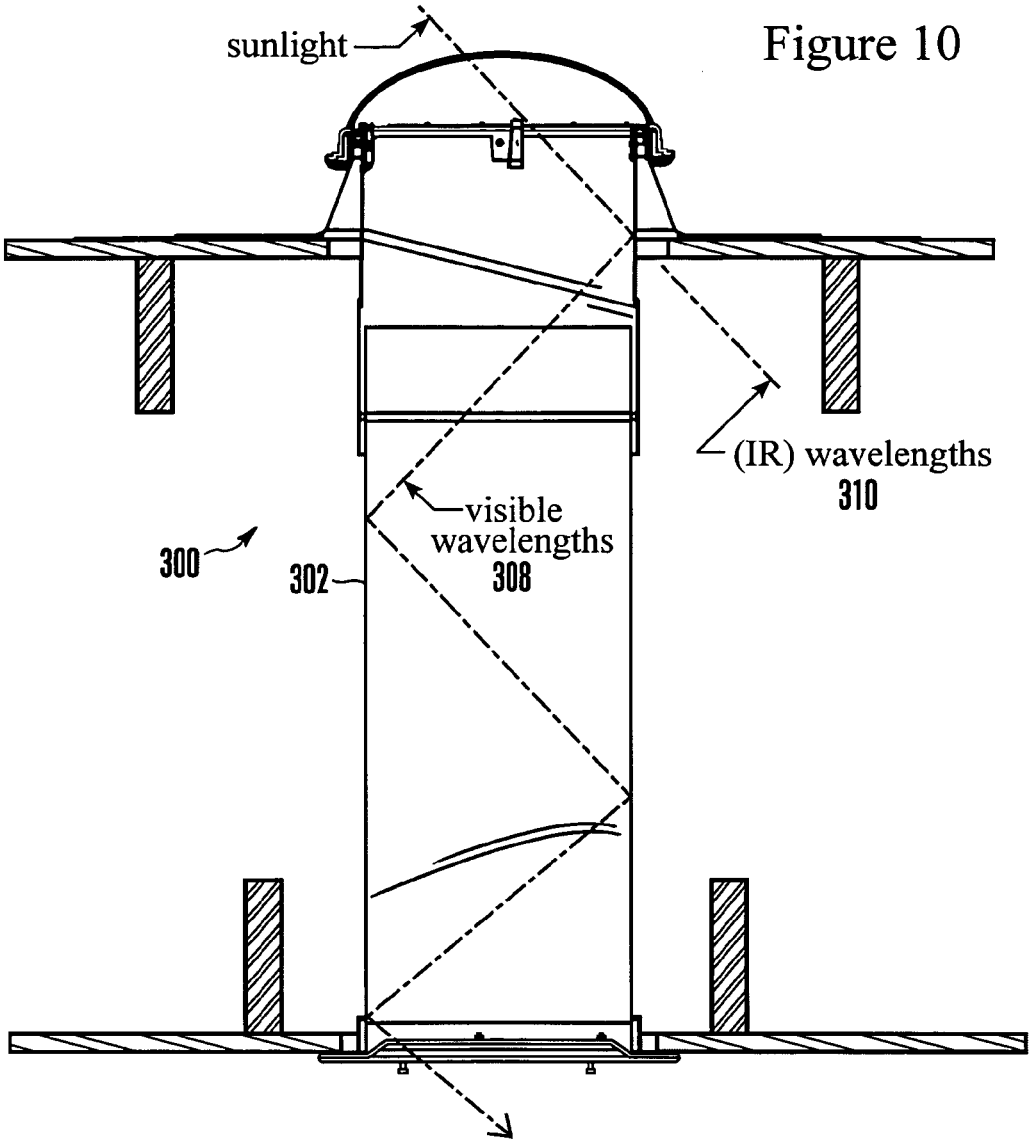
FIG. 10 is a side view in partial cross-section of yet another alternate tubular skylight of the present invention.
Figure 11:
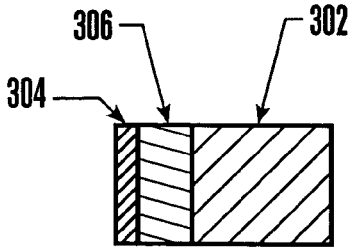
FIG. 11 is a cross-section of the tube substrate of FIG. 10.

FIGS. 10 and 11 show an additional alternate skylight assembly 300 that in all material respects is identical to the assembly 10 shown in FIG. 1 with the following exceptions. The assembly 300 shown in FIGS. 10 and 11 has a transparent plastic substrate 302 the inside surface of which is covered by a multi-layer film or coating 304 that is spectrally selective in that is reflects visible light while transmitting IR. The film or coating 304 may be adhered to the substrate by a clear adhesive 306 if desired. With this combination of structure, visible light is reflected down the tube within the tube as shown by lines 308 in FIG. 10, while IR is transmitted through the tube to its exterior as shown by liens 310.

While the particular SKYLIGHT TUBE WITH INFRARED HEAT TRANSFER is herein shown and described in detail, the invention is to be limited by nothing except the appended claims.

What is claimed is:

1. An apparatus comprising:

a substrate defining a first substantially black inside surface to absorb infrared light and a second outside surface rendered emissive of heat propagating from the first substantially black inside surface; and a substance associated with the first substantially black surface that substantially reflects visible light impinging on the substance and that substantially does not reflect IR light impinging on the substance.

2. The apparatus of claim 1, further comprising an adhesive disposed between the substance and the substrate.

3. The apparatus of claim 1, wherein the inside substantially black surface has a satin substantially black finish.

4. The apparatus of claim 3, wherein the outside surface is anodized or has other high emissive qualities.

5. A skylight assembly, comprising:

a transparent dome;

at least one skylight shaft substrate extending away from the dome to convey light entering the dome through the shaft substrate;

a spectrally selective film or coating juxtaposed with an inside surface of the shaft substrate to substantially reflect visible light and to substantially transmit IR light;

a means associated with the substrate for conveying heat from an inside surface to an outside surface of the shaft substrate; and wherein the means includes a satin black or other IR absorbing inside surface.

6. The assembly of claim 1, wherein the means for conveying heat includes an anodized or other high emissivity outer surface of the substrate.

7. A skylight shaft assembly, comprising:

a hollow shaft substrate defining an inside surface and an outer surface; and a substance associated with the inside surface that substantially reflects visible light impinging on the substance and that substantially does not reflect IR light impinging on the substance; and wherein an inside surface has a satin black or other IR absorbing finish.

8. The assembly of claim 7, wherein the outer surface is anodized or has other high emissive qualities.

9. A skylight shaft assembly comprising:

a hollow shaft substrate defining an inside surface and an outer surface; and means associated with the inside surface for substantially reflecting visible light but not IR light;

wherein the means for reflecting is a spectrally selective film bound to the inside surface by an adhesive; and wherein the inside surface has a satin black or other IR absorbing finish.

10. The assembly of claim 9, further comprising means associated with the substrate for conveying heat from the inside surface to the outer surface of the substrate.

* * * * *